United States Patent [19]

Fontana

[11] 4,328,840

[45] May 11, 1982

[54] DOUBLE SIDE FABRIC

[76] Inventor: Giulio Fontana, Via Carminati de Brambilla 43, Casatenovo (Como), Italy

[21] Appl. No.: 139,135

[22] Filed: Apr. 10, 1980

[30] Foreign Application Priority Data

Apr. 12, 1979 [IT] Italy ..... 21807 A/79

[51] Int. Cl.[3] ..... D03D 19/00

[52] U.S. Cl. ..... 139/419; 139/421

[58] Field of Search ..... 139/419, 421, 422, 423; 428/230, 231; 128/163, 164, 165, 166.5

[56] References Cited

U.S. PATENT DOCUMENTS

| | | | |
|---|---|---|---|
| 628,867 | 7/1899 | Strang | 139/419 |
| 1,707,956 | 4/1929 | Moore | 139/423 |
| 2,981,297 | 4/1961 | Rogers | 139/419 |
| 3,920,054 | 11/1975 | Goff et al. | 139/421 |
| 3,965,944 | 6/1976 | Goff et al. | 139/421 |

*Primary Examiner*—Henry Jaudon

*Attorney, Agent, or Firm*—Michael N. Meller; Anthony H. Handal

[57] ABSTRACT

Double side fabric, particularly useful for the manufacture of elastic bands and body-belts, the warp of which comprises in rubber or elastomeric material. Such a fabric has one side thereof which substantially comprises entirely a yarn of a given type, and the other side of which substantially completely comprises a yarn of a type different from that making up the first side.

7 Claims, 3 Drawing Figures

DOUBLE SIDE FABRIC

This invention relates to a double side fabric, and more particularly to a fabric, of which one side substantially completely comprises a yarn of a given type, and the other side of which substantially completely comprises a yarn of a type different from that forming the first side. Still more particularly, the warp of such a fabric comprises threads in rubber or elastomeric material, so that the fabric is conveniently suited for the manufacture of elastic bands.

The elastic bands of the prior art are manufactured by wool yarns, in the case mixed with threads in rubber or elastomeric material in order to meet such requirements as elasticity and containability and to ensure a perfect body adherence, and by other types of yarn serving the purpose of wool and rubber binding. In a fabric forming these elastic bands of the prior art, the two sides are substantially of the same composition.

It is the primary object of the present invention to provide an elastic fabric having two distinctingly different sides.

It is another object of the invention to provide a fabric of the above mentioned design, in which the threads in rubber or elastomeric material forming part of the fabric are firmly bound to the other threads, so as to be hardly unthreaded from the fabric.

It is a further object of the invention to provide a fabric which can be easily manufactured on looms of known type.

Such a double side fabric includes a warp comprising threads in rubber or elastomeric material and substantially inextensible threads, and a weft comprising threads of a different nature, parallel with one another and perpendicular to the weft rubber threads, the fabric being characterized in that the weft threads of a first type are arranged at one side of the warp threads, while weft threads of a second type are arranged at the other side of the warp threads, the weft threads of the first type are alternated to the weft threads of the second type, said inextensible warp threads form binding threads substantially parallel to the rubber threads and leno warp threads, respectively, with one binding thread and one leno warp thread positioned between two adjacent threads, and in that each of the binding threads first pass over a first and a second weft thread, then through the fabric to pass under a third and a fourth thread, then to pass again above the pair of the next weft threads and so on, and that on considering the same above mentioned weft threads, each of the leno warp threads pass over the first weft thread remaining at the other side of the warp rubber thread with respect to that part at which the above considered binding thread is located, then the leno warp thread returns to the same part of the binding thread, passing under the rubber thread, under said binding thread, over the second weft thread, under the third weft thread, over the fourth weft thread, over the above mentioned binding thread and again under the rubber thread to pass again over the next weft thread, at the other side of the rubber thread and so on.

In order that the structure and features of a double side fabric according to the invention and its weaving procedures be more clearly understood, a preferred but not restrictive embodiment thereof will now be described with reference to the accompanying drawing, in which.

Figure 1:
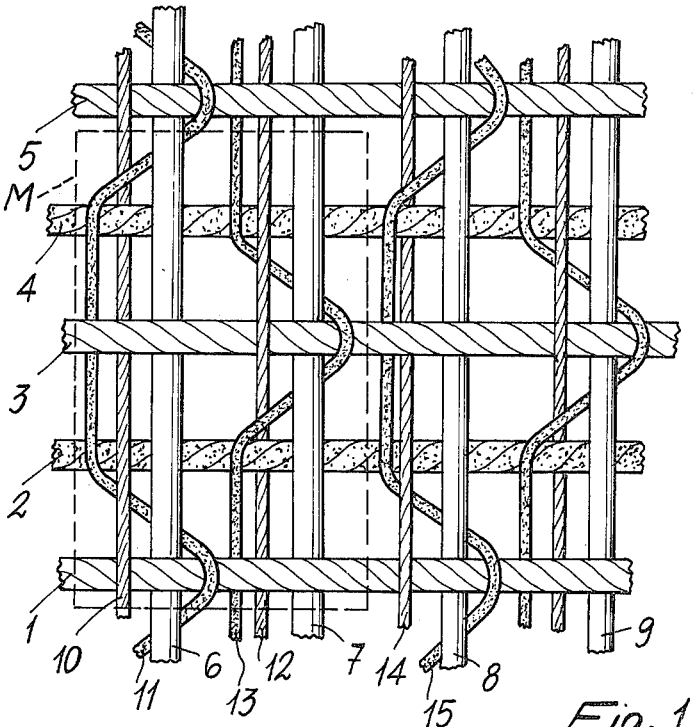
FIG. 1 is a schematic plan view on a very large scale and with stitches exagerately thinned out of the double side fabric.

Reference is firstly made to FIG. 1, in which a portion of the fabric according to the invention is shown on a greatly enlarged plane view and with the stitches exagerately thinned out, so that the path of the various threads can be located.

In this figure of the drawings, the fabric weave comprises a warp and a weft: the warp comprises threads in rubber or elastomeric material (6, 7, 8 and 9), binding threads (of which only two have been numbered and designated by reference numerals 10 and 12) substantially parallel with the rubber threads, and leno warp threads (of which only two have been designated by reference numerals 11 and 13 in the figure of the drawing). The weft comprises wool threads (1, 3 and 5) parallel with one another and all of which arranged above the rubber threads (6, 7, 8 and 9), such threads being perpendicular thereto, and threads (2 and 4) of different nature (for example of chlorofiber or the like), also parallel with one another and perpendicular to the rubber threads. From said FIG. 1, it can also be seen that all of the threads of chlorofiber (2 and 4) are arranged below the rubber threads and the wool threads (1, 3 and 5) are alternated to the chlorofiber threads (2 and 4).

In the fabric, the binding thread 10 first passes over the threads 1 and 2 (remaining on the upper side of the fabric relative to the drawing), then passes through the fabric to pass under the threads 3 and 4, and then passes again through the fabric to pass above the thread 5 and the weft thread next thereto, and so on repeating the same weave.

The leno warp thread 11 passes over the thread 1 (but remaining on the other side of the thread 6 relative to that side at which the thread 10 is located), then returns at the same side of the thread 10 passing under the thread 6 and said thread 10, then passes over the thread 2, under the thread 3, over the thread 4, then is diverted to the right passing over the thread 10 and under the thread 6, to pass again over the successive wool thread (5) at the other side of the thread 6 relative to thread 10, and so on.

The above description in connection with the warp threads (6, 10 and 11) is also applicable to the successive and analogous set of threads (7, 12 and 13), (8, 14 and 15) and to all of the subsequent sets. It will be appreciated that the weave of threads 10 and 11 on the weft threads (2 and 4) and (1, 3 and 5) respectively distributed under and other the warp threads (6, 7, 8 and 9) is the same as the weave formed by threads 12 and 13 with the weft threads, but the weave is reproduced and forms two weft threads in further forward direction considering a next warp rubber thread (6, 7, 8 and 9). In other words, the leno warp thread 13 in side by side relationship with the warp thread 7 passes over the wool thread 3 by two weft threads in further forward direction than the leno warp thread 11 (which passed over the wool thread 1) in side by side relationship with the warp thread 6. Thus, the fabric weave is repeated with the modularity as shown within the rectangle M shown by dashed line in FIG. 1.

In the above described double side fabric, the weft threads (1, 2, 3, 4 and 5) are much bigger than the binding threads (10, 12 and 14) and leno warp threads (11, 13 and 15). That being stated, it will be seen that all of the rubber threads (6, 7, 8 and 9) are always enclosed between the wool threads (1, 3 and 5) and chlorofiber threads (2 and 4) and that the binding threads and leno warp threads pass over the wool threads only at locations that are somewhat spaced apart from one another (obviously in connection with the size of the weave being considered). Thus, it will be appreciated that the threads 10 and 11 pass above the wool threads simultaneously in side by side relationship with one another and only on the warp thread 1 and then on thread 5.

Below the warp threads (2 and 4), the binding threads pass only at locations that are spaced apart from one another by a relatively large distance.

Therefore, on the upper side of the fabric there is a highly preponderant amount of wool threads relative to that of binding threads and leno warp threads (which, as previously stated, is limited only to very small areas where such threads step over the wool thread) which are also of a much smaller cross-section than that of the wool threads. Then, when closely examining FIG. 1, with particular attention to the location where a wool thread is embraced by the binding threads and leno warp threads, it will be appreciated that the wool threads adjacent and subsequent to that being considered form at one side a bridge or bridle of substantial length and at the other side of the location where the wool thread interposed therebetween is bound. A bridge or bridle is that portion of warp thread which is between two successive binding stitches thereon. For example, it will be seen that the binding location (where they step over the wool thread at the top) as determined by threads 12 and 13 on the wool thread 3 is juxtaposed by two bridles formed by thread 1 and thread 5, respectively, between the locations at which they are bound by the pairs of threads (10, 11) and (14, 15).

As a result, since said wool threads in the fabric are in side by side and contact relationship with one another and said bridles have some freedom of movement, such bridles overlap at the locations where the wool thread intermediate thereto is bound by the binding and leno warp threads. This is much more evident when considering that the binding threads and leno warp threads are of small cross-section and tend to downward pull the wool thread at the location where such a wool thread is hooked thereto.

All of the foregoing description in connection with the upper side of the fabric where the wool threads are arranged, is also applicable to the underside thereof where the chlorofiber threads are arranged.

Therefore, the above described fabric is a fabric having two fully distinct sides, that is (relative to the drawing and with the assumption of using the above mentioned yarns) with its upper side completely made of wool and its underside completely made of chlorofibers.

The structure of the above described fabric is further characterized in that the threads in rubber or elastomeric material (as well as the warp threads) are firmly bound and accordingly cannot become unthreaded, which affords a long life to the fabric.

For the manufacture of elastic bands, the fabric may be prepared with twisted wool threads with a count of Nm 2/32 (that is, two twisted threads of count 32, Nm meaning "metrical number"), two chlorofiber threads Nm 1/12, binding and leno warp threads of texturized two-terminal 150 denier polyester, and rubber threads having a count of 60.

Preferably, the rubber would be covered with viscose thread or with other yarns, in order to restrict the elongation, promote the dyeing, increase the resistance or strength and interfere with the slipping thereof upon fabric completion. It is apparent that, instead of rubber threads, threads of other elastomeric material may be used, and that the warp threads (2, 4) may be made of cotton, nylon or other material (instead of chlorofiber) etc.

As above stated, the fabric as described is particularly suitable for the manufacture of elastic bands and the user will gain the advantage of indifferently using either side of the fabric in contact with the skin, thus taking advantage of the different and peculiar properties resulting from the nature of the fibers making up each side of the fabric.

Then, it was found that owing to its structure, the fabric is indeed of unique softness and remarkable dimensional stability. The above described fabric is woven by the use of conventional double filler or double shuttle looms (with two bilateral change or switch shuttles, one shuttle inserting the wool and the other shuttle inserting the cholofiber yarn). For the preparation of the warp beams, the threads are wound up on the beams and the warp chains (assembly of threads wound up on the beams) are leno warp interwoven with the weft threads on the double filler loom.

The modalities for the manufacture of the double side fabric need not to be further disclosed, as being apparent to those skilled in the art from the foregoing description.

Figure 2:
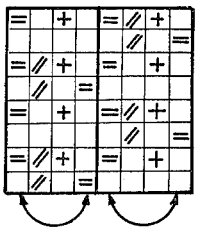
FIG. 2 is a view showing the scheme for the fabric weave.
Figure 3:
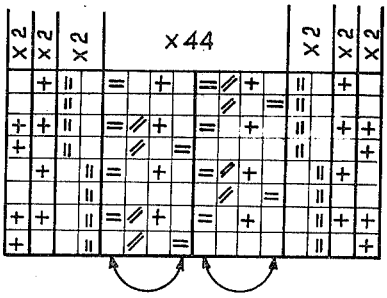
FIG. 3 is a view showing the scheme for the weave of an elastic band made with the fabric shown in FIGS. 1 and 2.

FIG. 2 shows the scheme for the weave of the fabric as described in connection with FIG. 1, and FIG. 3 shows the scheme for the weave integrally provided on a double filler loom. The schemes of FIGS. 2 and 3 show a fabric, the warp of which comprises 96 rubber threads (designated by reference symbol +), 88 binding threads of polyester (reference symbol ), 88 leno warp threads of polyester (reference symbol =) and 8 edge threads of polyester (reference symbol II). On the other hand, the weft comprises two upper fillings of wool Nm 2/32 and two lower fillings of chlorofiber Nm 1/12, simultaneously inserted. In a finished fabric, there may be 36 weft inserions/cm with 281 warp threads.

What I claim is:

1. A double side fabric comprising of a warp formed of threads of rubbery material and substantially inextensible threads and a weft formed of threads of different nature, parallel to one another and perpendicular to the warp rubbery threads, wherein the weft threads of a first type are arranged at one side of the warp threads, while weft threads of a second type are arranged at the other side of the warp threads, the weft threads of the first type are alternated to the weft threads of the second type, said inextensible warp threads form binding threads substantially parallel to the rubbery threads and leno warp threads, respectively, with one binding thread and one leno warp thread positioned between two adjacent rubbery threads, and wherein each of the binding threads first pass over a first and a second weft thread, then through the fabric to pass under a third and a fourth weft thread, then to pass again above the pair of the next weft threads and so on, and wherein on considering the same above mentioned weft threads, each of the leno warp threads pass over the first weft thread remaining at the other side of the warp rubber thread with respect to that part at which the above considered binding thread is located, then the leno warp thread returns to the same part of the binding thread passing under the rubbery thread, under said binding thread, over the second weft thread, under the third weft thread, over the fourth weft thread, over the above mentioned binding thread and again under the rubbery thread to pass again over the next weft thread, at the other side of the rubbery thread and so on to complete said fabric.

2. A double side fabric as in claim 1, wherein the interweaving of the binding and leno warp threads on the weft threads crossing a given rubbery thread is the same, but is displaced by two weft threads, as the interweaving is formed by other binding and leno warp threads on the rubbery threads crossing the warp rubbery thread adjacent to that being considered.

3. A double side fabric as in claim 2, wherein said weft threads are of a larger cross-sectional area than that of said binding and leno warp threads.

4. A double side fabric as in claim 2, wherein said weft threads of the first type comprise wool threads and weft threads of the second type comprise chlorofiber threads.

5. A double side fabric as in claim 1, wherein said weft threads are of a larger cross-sectional area than that of said binding and leno warp threads.

6. A double side fabric as in claim 5, wherein said weft threads of the first type comprise wool threads and weft threads of the second type comprise chlorofiber threads.

7. A double side fabric as in claim 1, wherein said weft threads of the first type comprise wool threads and said weft threads of the second type comprise chlorofiber threads.

* * * * *